US010770038B1

(12) United States Patent
Going

(10) Patent No.: US 10,770,038 B1
(45) Date of Patent: Sep. 8, 2020

(54) TWO PIECE SOUND-HOLE COVER

(71) Applicant: Custom Sound Hole Covers, Inc., Pinellas Park, FL (US)

(72) Inventor: William Dean Going, Pinellas Park, FL (US)

( * ) Notice: Subject to any disclaimer, the term of this patent is extended or adjusted under 35 U.S.C. 154(b) by 0 days.

(21) Appl. No.: 16/744,936

(22) Filed: Jan. 16, 2020

(51) Int. Cl.
*G10D 3/04* (2020.01)
*G10D 3/046* (2020.01)
*G10D 1/08* (2006.01)

(52) U.S. Cl.
CPC ..... *G10D 3/046* (2013.01); *G10D 1/08* (2013.01)

(58) Field of Classification Search
CPC ..... G10D 3/046
See application file for complete search history.

(56) References Cited

U.S. PATENT DOCUMENTS 3,636,809 A * 1/1972 Ezaki ..... G10D 1/08 84/263
4,024,788 A * 5/1977 Dunlap ..... G10D 3/046 84/267
4,394,830 A * 7/1983 Damiano ..... G10H 3/18 84/267
4,632,003 A * 12/1986 Kopp ..... G10D 1/085 84/267
4,649,793 A * 3/1987 Blackshear ..... G10D 3/00 84/453
4,748,886 A * 6/1988 De Byl ..... G10H 3/181 84/723
D393,275 S * 4/1998 Andrenacci ..... D17/20
6,681,661 B2 * 1/2004 Lalonde ..... G10D 3/02 84/267
9,646,581 B2 * 5/2017 Landis ..... G10D 3/00
9,940,912 B1 * 4/2018 Brandenstein ..... G10D 3/02
10,546,562 B1 * 1/2020 Baldevarona ..... G10D 1/08

* cited by examiner

*Primary Examiner* — Robert W Horn
(74) *Attorney, Agent, or Firm* — Larson & Larson, P.A.; Frank Liebenow; Justin P. Miller

(57) ABSTRACT

A sound-hole cover includes a frame member, insert member, and foam spring members. The frame member has a rim and a front surface that is recessed from the rim. The frame member also has a plurality of spring-loaded orifices and a back surface of the frame member has a plurality of spring member holders opening radially outwardly from a center point of the frame member. An insert member has a planar front surface and a plurality of pegs, each peg corresponding to one of the spring-loaded orifices such that when the pegs are inserted into the spring-loaded orifices, the insert member remains on the frame member within the rim. There are foam spring members, each foam spring member is held by a corresponding spring member holder of the frame member. The foam spring members removably hold the sound-hole cover within a sound-hole of a musical instrument.

15 Claims, 4 Drawing Sheets

TWO PIECE SOUND-HOLE COVER

FIELD

This invention relates to the field of stringed instruments and more particularly to an apparatus for removably covering a sound-hole of a stringed instrument such as a guitar.

BACKGROUND

Many hollow-bodied stringed instruments have what is known as a sound-hole in the face of the instrument beneath the strings, allowing for sound to emanate out of the hollow-body (and, unfortunately, foreign objects to fall into the hollow-body).

Many times, it is desired to dampen sound from entering the hollow-body, especially when the sound is amplified, as the sound from the amplifier causes increased vibration of the instrument's body, and at certain amplification levels, feedback occurs as this vibration is picked up and sent to the amplifier.

There exist a class of devices that are designed to mount in the sound-hole, especially the sound-hole of acoustic guitars, blocking acoustic sound waves from entering/exiting the sound-hole. For example, in U.S. Pat. No. 9,646,581 to Landis, a single-piece, mesh-type sound-hole cover is disclosed for the purpose of preventing foreign objects (e.g. picks) from entering the sound-hole. This device is held in place on the sound-hole by a plurality of adhesive fasteners. Many guitarists do not want to use any type of adhesive on their guitar as with time, heat, and humidity, even temporary fasteners often damage the surface of the instrument.

Likewise, there are many decorative, solid sound-hole covers on the market. These currently marketed sound-hole covers are typically solid plastic or wood parts that are sized for a particular set of instruments. The wooden sound-hole covers often come with an elaborate design that allows sound to enter/escape; only preventing objects from entering the sound-hole. Some sound-hole covers are printed with a manufacturer name or marketer name.

No existing sound-hole covers offer customization of the front facing surface with custom printing. Any printing that is done is at the factory in quantity; for example, production runs of 100s of sound-hole covers with a guitar manufacture name on the front facing surface. There is no way for a garage band to order two sound-hole covers with the name of the band, phone number, etc.

What is needed is a sound-hole cover that will provide decoration and dampen acoustic feedback.

SUMMARY

In one embodiment, a sound-hole cover is disclosed including a frame member that has a rim and a front surface that is recessed from the rim. The frame member also has a plurality of spring-loaded orifices and a back surface of the frame member has a plurality of spring member holders opening radially outwardly from a center point of the frame member. An insert member has a planar front surface and a plurality of pegs, each peg corresponding to one of the spring-loaded orifices such that when the pegs are inserted into the spring-loaded orifices, the insert member remains on the frame member within the rim. There are foam spring members, each foam spring member is held by a corresponding spring member holder of the frame member. The foam spring members removably hold the sound-hole cover within a sound-hole of a musical instrument.

In another embodiment, a method of covering a sound-hole of a musical instrument is disclosed including providing a sound-hole cover that has a frame member, an insert member, and foam spring members. The frame member has a rim and a front surface that is recessed from the rim. The frame member also has four spring-loaded orifices and a back surface of the frame member has three spring member holders opening radially outwardly from a center point of the frame member. The insert member has a planar front surface and four pegs, each peg corresponding to one of the four spring-loaded orifices such that when the pegs are inserted into the spring-loaded orifices, the insert member remains on the frame member within the rim. Three foam spring members are held by a corresponding spring member holder of the frame member. The foam spring members removably hold the sound-hole cover within a sound-hole of the musical instrument. The method includes inserting the pegs of the insert member into the spring-loaded orifices of the frame member, thereby holding the insert member against the frame member and installing the frame member against the sound-hole of the musical instrument such that the foam spring members press against an inner edge of the sound-hole of the musical instrument, thereby holding the sound-hole cover against a body of the musical instrument until removed.

In another embodiment, a sound-hole cover is disclosed including a frame member that has a rim and a front surface that is recessed from the rim. The frame member has four spring-loaded orifices and a back surface of the frame member has three spring member holders opening radially outwardly from a center point of the frame member. An insert member has a planar front surface and four pegs, each peg corresponding to one of the four spring-loaded orifices such that when the pegs are inserted into the spring-loaded orifices, the insert member remains on the frame member within the rim. Three foam spring members are inserted into and held by a corresponding spring member holder of the frame member. The foam spring members removably hold the sound-hole cover within a sound-hole of a musical instrument.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
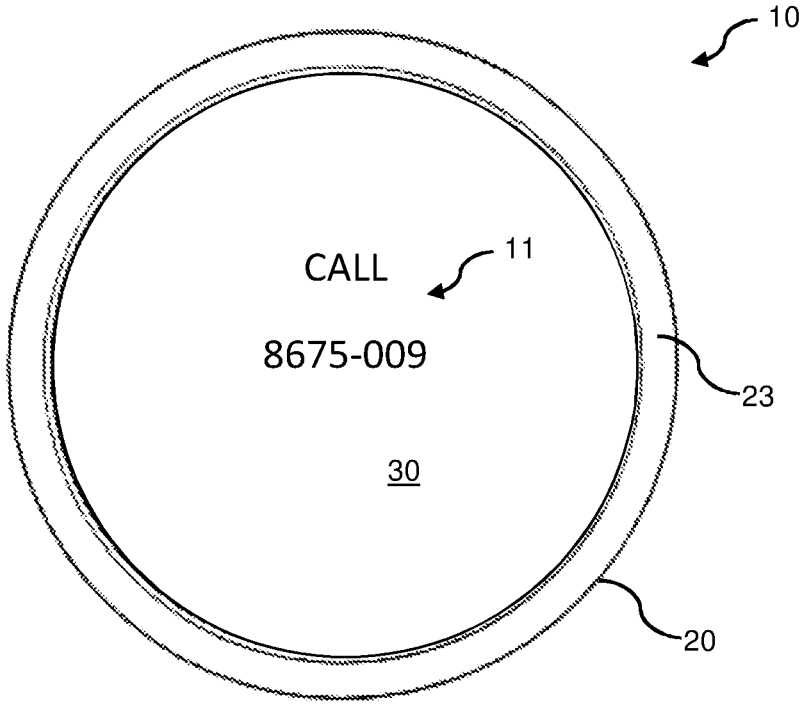
FIG. 1 illustrates a plan view of a sound-hole cover.

Reference will now be made in detail to the presently preferred embodiments of the invention, examples of which are illustrated in the accompanying drawings. Throughout the following detailed description, the same reference numerals refer to the same elements in all figures.

Referring to FIG. 1, the sound-hole cover 10 is shown assembled, ready to place into a sound-hole of, for example, a guitar. The sound-hole cover 10 is made from a frame member 20 and an insert member 30. The insert member 30 is held to the frame member 20 by a series of pegs 32 of the insert member 30 (see FIGS. 5 and 7) that are frictionally held into spring members 27 (see FIGS. 2-4) of the frame member 20. In this way, the sound-hole cover is manufactured by simple injection molding utilizing simple molds that do not require inserts or other moving pieces. Another advantage of making the sound-hole cover 10 to include a frame member 20 and a separate insert member 30 is that many musicians are interested in decorative covers having, for example, names or logos 11 on the outward facing surface of the cover. Prior covers provide decorative wood pattern designs, and some have company names (e.g. a guitar manufacturer name). The insert member 30 of the sound-hole cover 10 has a planar face 30F (see FIG. 6) that is configured for ease of printing, then coating with a clear coating such as urethane or epoxy paint.

Figure 2A:
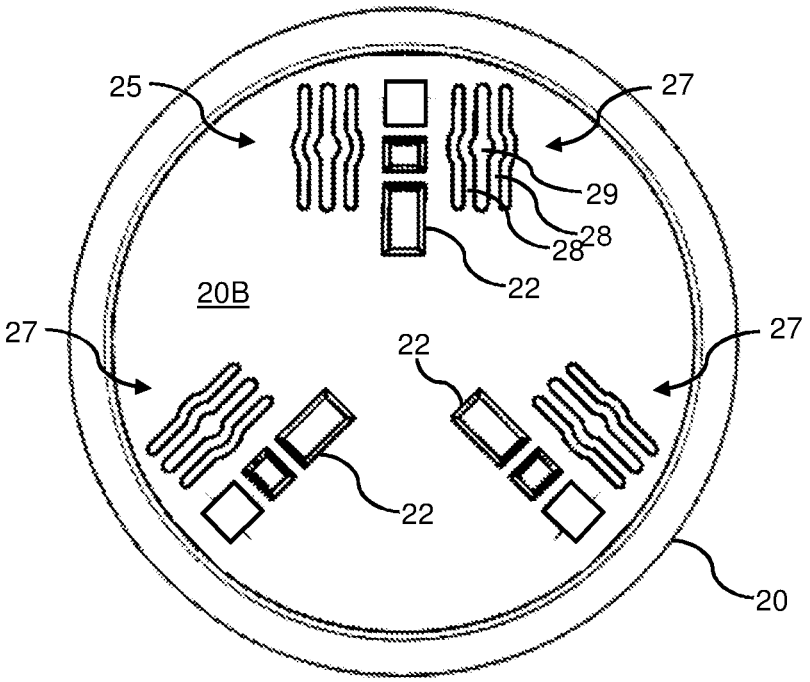
FIG. 2A illustrates a bottom view of a frame member of the sound-hole cover.
Figure 3:
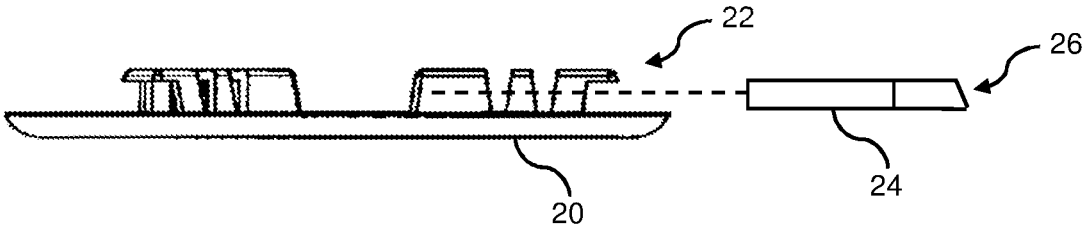
FIG. 3 illustrates a side view of the frame member of the sound-hole cover.
Figure 2B:
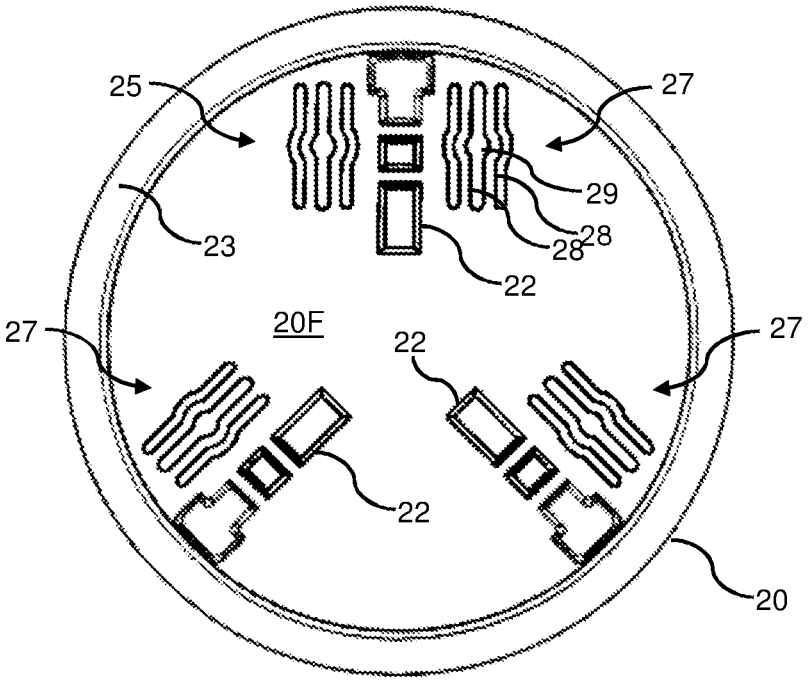
FIG. 2B illustrates a top view of a frame member of the sound-hole cover.

Referring to FIGS. 2A, 2B, and 3, a frame member 20 of the sound-hole cover 10 is shown. In FIG. 2, the back side 20B (see FIG. 2A) of the frame member 20 of the sound-hole cover 10 is shown having a plurality (four are shown) of spring members 27 for accepting and holding a corresponding plurality of pegs 32 of the insert member 30 (see FIGS. 5 and 7) by way of friction. In this, the spring-loaded orifices 29 that are central to the spring members 27 are formed between two spring arms 28. When each peg 32 is inserted into the spring-loaded orifices 29, the spring arms 28 exert force onto the pegs 32 to hold the insert member 30 against the frame member 20.

Although four spring members 27 and four pegs 32 are shown, any number is anticipated, including spring member 27 and one peg 32.

Figure 4:
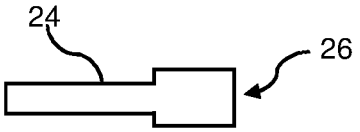
FIG. 4 illustrates a top view of a spring of the sound-hole cover.

As shown in FIGS. 3 and 4, foam spring members 24 slide into spring member holders 22 of the back side 20B. Each foam spring member 24 has an angled outward facing surface 26.

The frame member 20 has a greater diameter than the targeted sound-hole, thereby a back surface of the frame member 20 rests against the edge of the sound-hole when installed. When the sound-hole cover 10 is inserted into the sound-hole, the foam spring members 24 deform slightly, permitting the frame member 20 to fit snuggly within the sound-hole, then the foam spring members 24 push outwardly, radially, exerting force against an inside edge of the sound-hole to prevent the sound-hole cover 10 from falling out of the sound-hole during use or storage of the musical instrument. Although three spring member holders 22 and a corresponding three foam spring members 24 are shown, any number of such is anticipated. The foam spring members 24 provide a positive holding pressure between the sound-hole cover 10 and the sound-hole without the use of adhesives or locking mechanisms that have been used in the past.

As shown in FIG. 2B, the front side 20F of the frame member 20 is recessed from an outer decorative rim 23 of the frame member 20 so that, when the insert member 30 is inserted into the frame member 20, the insert member 30 is substantially flush with the outer decorative rim 23.

Referring to FIG. 4, a top view of a foam spring member 24 of the sound-hole cover 10 is shown. Note that in some embodiments, each of the foam spring members 24 has a head that is wider than its body so that the head prevents excessive insertion of the foam spring member 24 into the spring member holder 22.

Figure 5:
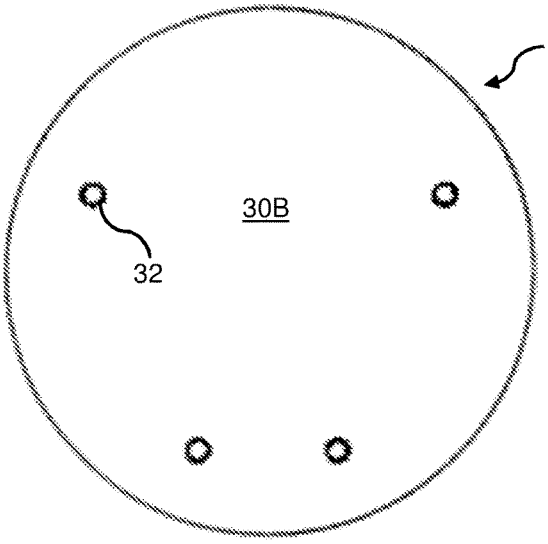
FIG. 5 illustrates a bottom view of an insert of the sound-hole cover.
Figure 6:
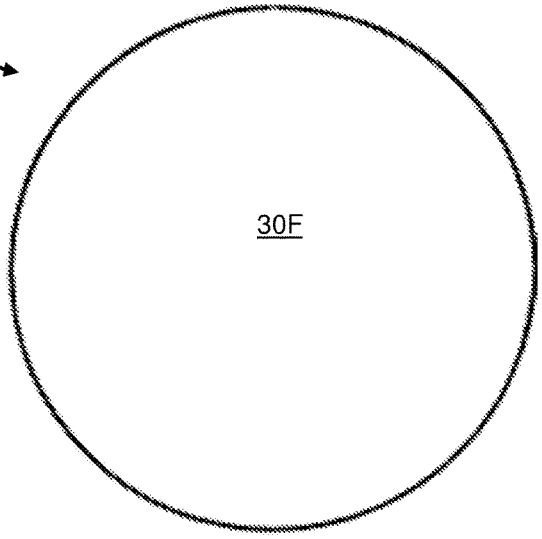
FIG. 6 illustrates a top view of an insert of the sound-hole cover.
Figure 7:
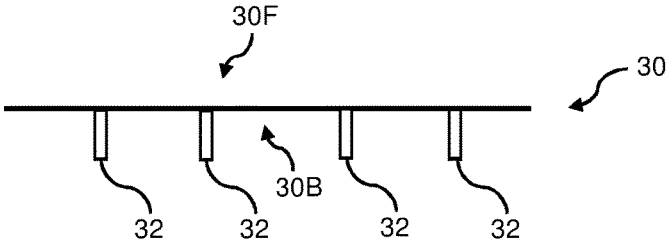
FIG. 7 illustrates a side view of an insert of the sound-hole cover.

Referring to FIGS. 5-7, an insert member 30 of the sound-hole cover is shown. In FIG. 5, the back surface 30B (the side that interfaces with the frame member 20) of the insert member 30 is shown having four pegs 32 strategically located to mate with the four spring-loaded orifices 29 of the frame member 20 such that, when the insert member 30 mates with the frame member 20, each peg is held with a corresponding spring-loaded orifices 29 by force of spring arms 28. Alternately, the frame member 20 is used without the insert member 30, allowing a small amount of sound to pass through the spring-loaded orifices 29 and around the spring arms 28.

The planar face 30F of the insert member 30 faces outwardly when the sound-hole cover 10 is mounted into a sound-hole of an instrument. The planar face 30F is planar allowing for simple printing of artwork, letters/words, logos, band names, sponsor names, etc. For example, a music store might provide sound-hole cover 10 at a low cost or for free having the store's logo, name, and/or phone number for advertising purposes.

In FIG. 7, a side view of the insert member 30 is shown. Note that the pegs 32 emanate from the back surface 30B of the insert member 30 and are cylindrical. As such, during the molding process, a two-part mold is used, allowing for easy separation of the two parts after cooling of the insert member 30.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A sound-hole cover comprising:

a frame member, the frame member having a rim and a front surface that is recessed from the rim, the frame member having a plurality of spring-loaded orifices, a back surface of the frame member having a plurality of spring member holders opening radially outwardly from a center point of the frame member;

an insert member having a planar front surface and a plurality of pegs, each peg corresponding to one of the spring-loaded orifices such that when the pegs are inserted into the spring-loaded orifices, the insert member remains on the frame member within the rim; and a plurality of foam spring members, each foam spring member held by a corresponding spring member holder of the frame member, the foam spring members for removably holding the sound-hole cover within a sound-hole of a musical instrument.

2. The sound-hole cover of claim 1, wherein the musical instrument is an acoustic guitar.

3. The sound-hole cover of claim 1, wherein the front surface of the insert member is printed with any member selected from the group consisting of letters, words, artwork, color patterns, and logos.

4. The sound-hole cover of claim 1, wherein the plurality of pegs consists of four pegs.

5. The sound-hole cover of claim 1, wherein the plurality of spring-loaded orifices consists of four spring-loaded orifices.

6. The sound-hole cover of claim 1, wherein each of the plurality of spring member holders opening radially outwardly from the center point of the frame member are equally spaced from each other.

7. The sound-hole cover of claim 1, wherein the plurality of spring member holders consists of three spring member holders opening radially outwardly from the center point of the frame member, each spring member holder being equally spaced from each other spring member holder.

8. A method of covering a sound-hole of a musical instrument comprising:

providing a sound-hole cover comprising:

a frame member, the frame member having a rim and a front surface that is recessed from the rim, the frame member having four spring-loaded orifices, a back surface of the frame member having three spring member holders opening radially outwardly from a center point of the frame member;

an insert member having a planar front surface and four pegs, each peg corresponding to one of the four spring-loaded orifices such that when the pegs are inserted into the spring-loaded orifices, the insert member remains on the frame member within the rim;

three foam spring members, each foam spring member held by a corresponding spring member holder of the frame member, the foam spring members for removably holding the sound-hole cover within a sound-hole of the musical instrument;

inserting the pegs of the insert member into the spring-loaded orifices of the frame member, thereby holding the insert member against the frame member; and installing the frame member against the sound-hole of the musical instrument such that the foam spring members press against an inner edge of the sound-hole of the musical instrument, thereby holding the sound-hole cover against a body of the musical instrument until removed.

9. The method of claim 8, wherein the musical instrument is an acoustic guitar.

10. The method of claim 8, further comprising before the step of inserting:

printing any member selected from the group consisting of letters, words, artwork, color patterns, and logos onto the front surface of the insert member.

11. The method of claim 10, further comprising after the step of printing:

coating the front surface of the insert member with a clear coat.

12. A sound-hole cover comprising:

a frame member, the frame member having a rim and a front surface that is recessed from the rim, the frame member having four spring-loaded orifices, a back surface of the frame member having three spring member holders opening radially outwardly from a center point of the frame member;

an insert member having a planar front surface and four pegs, each peg corresponding to one of the four spring-loaded orifices such that when the pegs are inserted into the spring-loaded orifices, the insert member remains on the frame member within the rim; and three foam spring members, each foam spring member held by a corresponding spring member holder of the frame member, the foam spring members for removably holding the sound-hole cover within a sound-hole of a musical instrument.

13. The sound-hole cover of claim 12, wherein the musical instrument is an acoustic guitar.

14. The sound-hole cover of claim 12, wherein the front surface of the insert member is printed with any member selected from the group consisting of letters, words, artwork, color patterns, and logos.

15. The sound-hole cover of claim 12, wherein each of the plurality of spring member holders opening radially outwardly from the center point of the frame member are equally spaced from each other of the spring member holders.

* * * * *